United States Patent [19]

Schade, Jr.

[11] 4,325,018

[45] Apr. 13, 1982

[54] TEMPERATURE-CORRECTION NETWORK WITH MULTIPLE CORRECTIONS AS FOR EXTRAPOLATED BAND-GAP VOLTAGE REFERENCE CIRCUITS

[75] Inventor: Otto H. Schade, Jr., North Caldwell, N.J.

[73] Assignee: RCA Corporation, New York, N.Y.

[21] Appl. No.: 177,915

[22] Filed: Aug. 14, 1980

[51] Int. Cl.[3] ..... G05F 3/20

[52] U.S. Cl. ..... 323/313; 307/310; 323/316; 330/289

[58] Field of Search ..... 330/288, 289, 296, 297; 323/313-316; 307/297 R, 310

[56] References Cited

U.S. PATENT DOCUMENTS

| | | | |
|---|---|---|---|
| 3,809,929 | 5/1974 | Vittoz | 307/310 |
| 3,886,435 | 5/1975 | Steckler | 307/297 |
| 3,893,018 | 7/1975 | Marley | 323/313 |
| 4,172,992 | 10/1979 | Culmer et al. | 307/297 |
| 4,176,308 | 11/1979 | Dobkin et al. | 307/297 |
| 4,243,948 | 1/1981 | Schade | 330/289 |
| 4,249,122 | 2/1981 | Widlar | 323/313 |
| 4,250,445 | 2/1981 | Brokaw | 323/313 |

OTHER PUBLICATIONS

Gray & Meyer, *Analysis and Design of Analog Integrated Circuits,* Section A4.3.2, "Band-Gap Reference Biasing CKT", pp. 254-261, 1977.

Vande Piassche, Digest of Technical Papers, 1976, IEEE Int. Solid-State Circuits Conference, Session XIII, THPM 13.3, pp. 148-149, 240.

*Primary Examiner*—William H. Beha, Jr.

*Attorney, Agent, or Firm*—Eugene M. Whitacre; Paul J. Rasmussen; Clement A. Berard, Jr.

[57] ABSTRACT

A correction network for a bow-shaped temperature characteristic includes a resistor and a semiconductor junction having different temperature coefficients and operated with related potentials thereacross to generate temperature-dependent currents responsive to an input current. That temperature-dependent current is subtractively combined with a reference current of predetermined value so that a corrective current, the magnitude of which is usually substantially zero at a predetermined temperature and is temperature-dependent at either higher and lower temperatures, respectively, is generated. In a particular embodiment, a first such corrective current is applied to a node of an extrapolated band-gap voltage reference circuit to tend to reduce the degree to which the reference potential departs from a desired value at temperatures higher than the predetermined temperature. A second corrective current is applied to the same or a different node thereof to tend to reduce the degree to which the reference potential departs from the desired value at temperatures lower than the predetermined temperature.

29 Claims, 6 Drawing Figures

TEMPERATURE-CORRECTION NETWORK WITH MULTIPLE CORRECTION AS FOR EXTRAPOLATED BAND-GAP VOLTAGE REFERENCE CIRCUITS

This invention relates to networks for developing multiple temperature dependent currents for compensating electrical circuits and, in particular, to networks for reducing the temperature variation of the reference potential from extrapolated band-gap reference potential circuits.

In an extrapolated band-gap volage reference circuit, a pair of bipolar transistors is operated at different emitter current densities, the difference between their base-emitter voltages exhibiting a positive temperature coefficient. That difference is scaled up and combined with a semiconductor junction conduction voltage exhibiting a negative temperature coefficient to develop a reference potential exhibiting a substantially reduced temperature coefficient as compared to that of the semiconductor junction.

A band-gap reference potential temperature characteristic is "bow-shaped" in that it tends to have a maximum value at a predetermined temperature and lesser values at higher and lower temperatures, as described in P. Gray and R. Meyer, *Analysis and Design of Analog Integrated Circuits,* Section A4.3.2 Band-Gap Reference Biasing Circuits, pages 254–61. Departures from an invariant reference potential are undesirable because those departures introduce error into the circuits in which the reference potential generating circuit is employed. For example, the accuracy of analog-to-digital conversion circuits and voltage regulator circuits is limited by the accuracy of their reference voltage.

Arrangements according to the present invention develop a temperature dependent current at temperatures either above or below a threshold temperature. This desirably allows for generation of multiple correction currents independent of the electrical circuit to be compensated. Each such correction current can be of the same or different magnitude, and of the same or different threshold temperature. Thus, the magnitudes and threshold temperature associated with each correction current can be separately selected to obtain the desired degree of correction of the temperature dependent characteristic of the circuit being compensated.

The present invention is an arrangement for correcting the temperature characteristic of an electrical circuit. Specifically, the temperature correction network includes a resistor and a semiconductor junction having different temperature coefficients and operated so that the potentials thereacross are in predetermined relationship to generate temperature-dependent currents therethrough. A current responsive to a portion of the current through one of the resistor and the semiconductor junction is subtractively combined with a reference current, and a current responsive to the subtractively combined current is applied to an electrical circuit to be compensated. For example, to compensate a reference potential generating circuit, the subtractively combined current is applied so as to tend to increase the reference potential at temperatures departing from the predetermined temperature. In the drawings:

Figure 1:
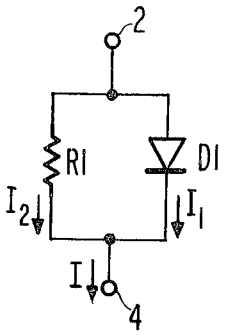
FIG. 1 is a schematic diagram of a portion of the present invention useful for the understanding thereof.

In the circuit of FIG. 1, resistor R1 is in parallel connection with a semiconductor junction shown by way of example as diode D1. Consider a current I applied between connections 2 and 4 conditioning D1 for conduction of current $I_1$. Because the condition potential of D1 is impressed across R1, current $I_2$ flows therethrough.

Where D1 is a silicon PN junction diode, for example, it exhibits a temperature coefficient of approximately −2 millivolts/degree Kelvin. Resistor R1 exhibits a different temperature coefficient. As the temperature of D1 increases, its conduction potential decreases causing a corresponding decrease in the potential across and the current conducted through R1. If current I applied between terminals 2 and 4 is unchanged, then current $I_1$ in diode D1 must increase by a complementary amount since $I_1+I_2=I$. On the other hand, when the temperature of D1 decreases, the current $I_2$ conducted by R1 tends to increase and the current $I_1$ conducted by D1 tends to decrease. The net effect is that complementary temperature-dependent currents $I_1$ and $I_2$ flow in D1 and R1, respectively, responsive to current I applied between connections 2 and 4.

Figure 2:
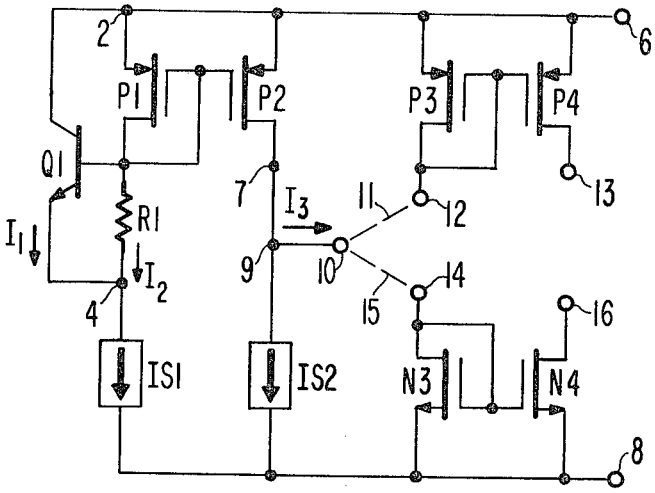
FIG. 2 is a schematic diagram of an embodiment of the present invention.

In FIG. 2, transistor Q1 conducts current $I_1$ between connections 2 and 4 responsive to the current applied by current source IS1. The potential across R1 is maintained equal to the base-emitter conduction potential of Q1, due to the parallel connection of R1 and the base-emitter of Q1, so that current $I_2$ flows in resistor R1.

P-channel field-effect transistors (FET) P1 and P2 serve as the input and output transistors, respectively, of a current mirror amplifier (CMA) receiving a portion of current $I_2$ flowing in R1 and supplying a current responsive thereto at its output connection 7. The current supplied by the P1, P2 CMA is subtractively combined with a reference current from constant current generator IS2 at node 9 producing subtractively combined current $I_3$.

If a temperature $T_P$ is defined as that temperature at which $I_3$ is equal to zero, than, owing to the temperature dependence of current $I_2$ flowing in R1, current $I_3$ tends to flow in the direction indicated by the arrow at temperatures below $T_P$ and tends to flow in the direction opposite to that indicated at temperatures above $T_P$.

The temperature bow-correction circuit of FIG. 2 is adaptable for generating a corrective current at temperatures above or at temperatures below temperature $T_P$. Corrective currents are generated at temperatures above $T_P$ when input connection 12 of the CMA formed by FETs P3 and P4 connects to node 9 via terminal 10 and conductor 11. Since the P3, P4 CMA is responsive only to currents flowing from relatively positive supply terminal 6 to connection 12, currents supplied from output connection 13 are substantially zero at temperatures below $T_P$ and are responsive to current $I_3$ at temperatures above $T_P$.

On the other hand, corrective currents at temperatures below $T_P$ are generated when input connection 14 of the CMA including N-channel FETs N3 and N4 connects to node 9 via terminal 10 and conductor 15. Since the N3, N4 CMA is responsive only to currents flowing from its input connection 14 to supply terminal 8, currents conducted between output connection 16 and relatively negative supply terminal 8 by FET N4 are substantially zero at temperatures above $T_P$ and are responsive to current $I_3$ at temperatures below $T_P$.

Circuits of the type shown in FIG. 2 are desirably constructed in monolithic integrated circuit (I.C.) form by a complementary symmetry, metal-oxide-semiconductor (COSMOS) technology. In COSMOS, both P- and N-channel FETs are constructed along with vertical PNP transistors such as Q1, the collector of which connects to the substrate of the I.C.

Figure 3:
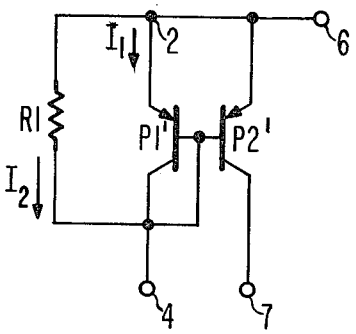
FIG. 3 is a schematic diagram of an alternative embodiment useful in the circuit of FIG. 2.

FIG. 3 shows an alternative connection for resistor R1 and a semiconductor junction provided by the base-emitter junction of PNP bipolar transistor P1'. In addition to serving as the semiconductor junction generating temperature dependent currents, transistor P1' serves as the input transistor of a CMA including output transistor P2'. The collector current of P2' is thus responsive to current $I_1$.

When the circuit of FIG. 3 is employed in the circuit of FIG. 2 to replace Q1, R1, P1 and P2 (by connecting correspondingly numbered connections in the circuit of FIG. 3 to those of FIG. 2), corrective currents obtained at connection 7 are then responsive to temperature dependent complementary current $I_1$. Corrective currents at temperatures below $T_P$ are then supplied at connection 13 when connection 11 is employed. Corrective currents at temperatures above $T_P$ are then supplied at connection 16 when connection 15 is employed.

Figure 4:
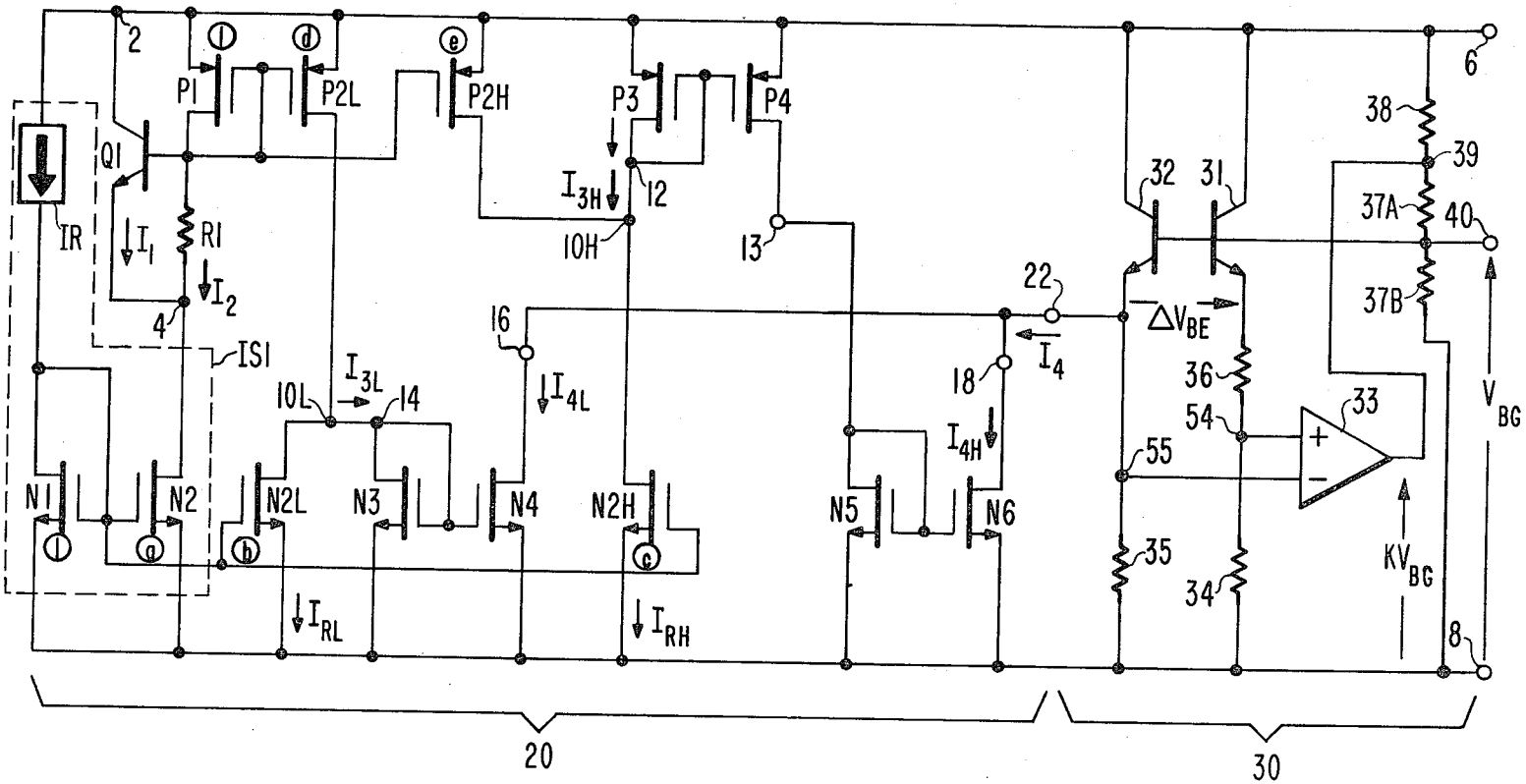
FIGS. 4 and 5 are schematic diagrams of extrapolated band-gap voltage reference circuits employing embodiments of the present invention.

In FIG. 4, reference potential generating circuit 30 develops band-gap reference potential $V_{BG}$ between output terminal 40 and supply terminal 8. Bow-correction network 20 supplies corrective currents to reference circuit 30. In the circuits of FIG. 4, signals corresponding to signals of the circuits of FIG. 2 have the same designations.

In reference circuit 30, NPN transistors 31 and 32 are conditioned to operate at different emitter current densities, the resulting difference $\Delta V_{BE}$ in their base-emitter conduction potentials appearing between their respective emitter electrodes. Amplifier 33 completes a degenerative feedback connection to maintain nodes 54 and 55 at substantially equal potentials, feedback signals being coupled to the bases of transistors 31 and 32 via node 39 and resistor 37A. Operating currents for transistors 31 and 32 are determined in substantial part by the values of resistors 34 and 35, respectively.

Difference potential $\Delta V_{BE}$ is impressed across resistor 36 and scaled up by resistor 34. The potential across resistor 35 is summed with the base-emitter potential of transistor 32 to develop reference potential $V_{BG}$. Output voltage from amplifier 33 is applied to the voltage divider formed by resistors 37A and 37B to develop $V_{BG}$. As a result, a further reference potential $kV_{BG}$ is available at node 39. The multiplicative factor relating those potentials is $k=(R_{37A}+R_{37B})/R_{37B}$. Resistor 38 supplies a relatively small starting current from relatively positive supply terminal 6 to the bases of transistors 31 and 32 via node 39 and resistor 37A to ensure that circuit 30 becomes operative responsive to operating potential applied between supply terminals 6 and 8.

In temperature bow-correction network 20, IS1 includes a current mirror amplifier (CMA) formed by input FET N1 receiving input current from current source IR. Drain current form output FET N2 is applied to resistor R1 and the base-emitter semiconductor junction of Q1 at terminal 4. The N1, N2 CMA includes further output transistors N2L and N2H, the drain currents of which are reference currents for the low and high temperature correction circuit portions, respectively, of bow-correction network 20. CMA output transistors N2, N2L and N2H can have different width-to-length (W/l) ratios so that their respective drain currents may be in different proportion to the CMA input current. This is indicated in the FIGURES by the encircled characters proximate to the transistors, e.g., a, b and c proximate to N2, N2L and N2H. FETs P1, P2L and P2H form a CMA supplying temperature dependent currents from the drains of output FETs P2L and P2H, each responsive to temperature dependent current $I_2$ flowing in R1 and input FET P1.

Corrective current $I_{3L}$ for temperatures below predetermined temperature $T_P$ is developed by the subtractive combination of drain current from FET P2L and reference current $I_{RL}$ from FET N2L at node 10L. The N3, N4 CMA receives current $I_{3L}$ an input connection 14 and supplies low-temperature corrective current $I_{4L}$ at output connection 16. Because the N3, N4 CMA responds only to currents flowing from node 10L to terminal 8 in the direction indicated by the arrow associated with $I_{3L}$, current $I_{4L}$ is responsive to $I_{3L}$ at temperatures below a threshold temperature $T_L$ and is substantially zero at temperatures above $T_L$. In practice, $T_L$ is selected to be near to $T_P$ and is the temperature at which the respective drain currents of P2L and N2L are of equal value.

In similar fashion, corrective current $I_{3H}$ for temperatures above $T_P$ is developed by subtractively combining drain current of P2H and reference current $I_{RH}$ from drain of N2H at node 10H. The P3, P4 CMA receives current $I_{3H}$ at its input connection 12 and supplies, following inversion in the N5, N6 CMA, high-temperature corrective current $I_{4H}$ at connection 18. Because the P3, P4 CMA responds only to currents flowing from terminal 6 to node 10H in the direction indicated by the arrow associated with $I_{3H}$, current $I_{4H}$ is responsive to $I_{3H}$ at temperatures above a threshold temperature $T_H$ and is substantially zero at temperatures below $T_H$. In practice, $T_H$ is selected to be near to $T_P$ and is the temperature at which the respective drain currents of P2H and N2H are of equal value.

Total corrective current $I_4$ is applied to reference potential generating circuit 30 via connection 22 and comprises corrective current $I_{4L}$ at temperatures lower than $T_L$ and corrective current $I_{4H}$ at temperatures higher than $T_H$. In practice, with $T_L$ and $T_H$ selected to be near $T_P$, current $I_4$ tends to have its minimum value near predetermined temperature $T_P$.

Corrective current $I_4$ is applied at the emitter of transistor 32 to increase its emitter current at temperatures higher or lower than $T_P$. As a result, the base-emitter potential of transistor 32 is increased above the value that it would exhibit absent corrective current $I_4$. This causes reference potential $V_{BG}$ to tend to increase relative to the value that it would exhibit absent the application of the corrective current $I_4$ at temperatures different from $T_P$. As a result, the degree to which $V_{BG}$ exhibits a bow-shape is desirably reduced.

Circuits of the type shown in FIG. 4 are desirably embodied in COSMOS integrated circuits since they employ only P- and N-channel FETs and NPN bipolar transistors having their collectors connected to relatively positive supply terminal 6. In one such embodiment, the present inventor has selected the values and characteristics listed in TABLE I below. These values are considered as illustrative and as such are subject to refinement or modification in light of subsequently acquired experience and particular performance requirements.

TABLE I

| Transistor | Relative Ae |
|---|---|
| 31 | 10 |
| 32 | 1 |
| **FET** | **Relative W/l** |
| P1, P2L, P2H, P4 | 1 |
| P3, N3 | 4 |
| N1, N2L, N4, N5, N6 | 1 |
| N2 | 2 |
| N2H | 8 |
| **Resistors** | **Value** |
| R1 | 14KΩ |
| 34 | 60KΩ |
| 35 | 6.7KΩ |
| 36 | 12KΩ |
| 37A,37B | 5KΩ |
| 38 | 20KΩ |
| **Currents** | **Value** |
| $I_1 + I_2$ | 100uA |
| $I_{RL}$ | 50-55uA |
| $I_{RH}$ | 30-35uA |
| **Temperatures** | **Range** |
| $T_L$ | 0-25° C. |
| $T_H$ | 75-100° C. |
| $T_P$ | ≃50° C. |

In practice, it is desirable that current supply IS1 develop currents of predetermined and stable value. One means for achieving that end is a regenerative non-linear current loop described in U.S. Pat. No. 4,063,149 entitled "Current Regulating Circuits" issued to B. Crowle. Crowle's current loop is employed in the band-gap reference circuit in conjunction with bow-correction network 20' of FIG. 5, which circuits are of a form desirably embodied in a BIMOS integrated circuit.

Figure 5:
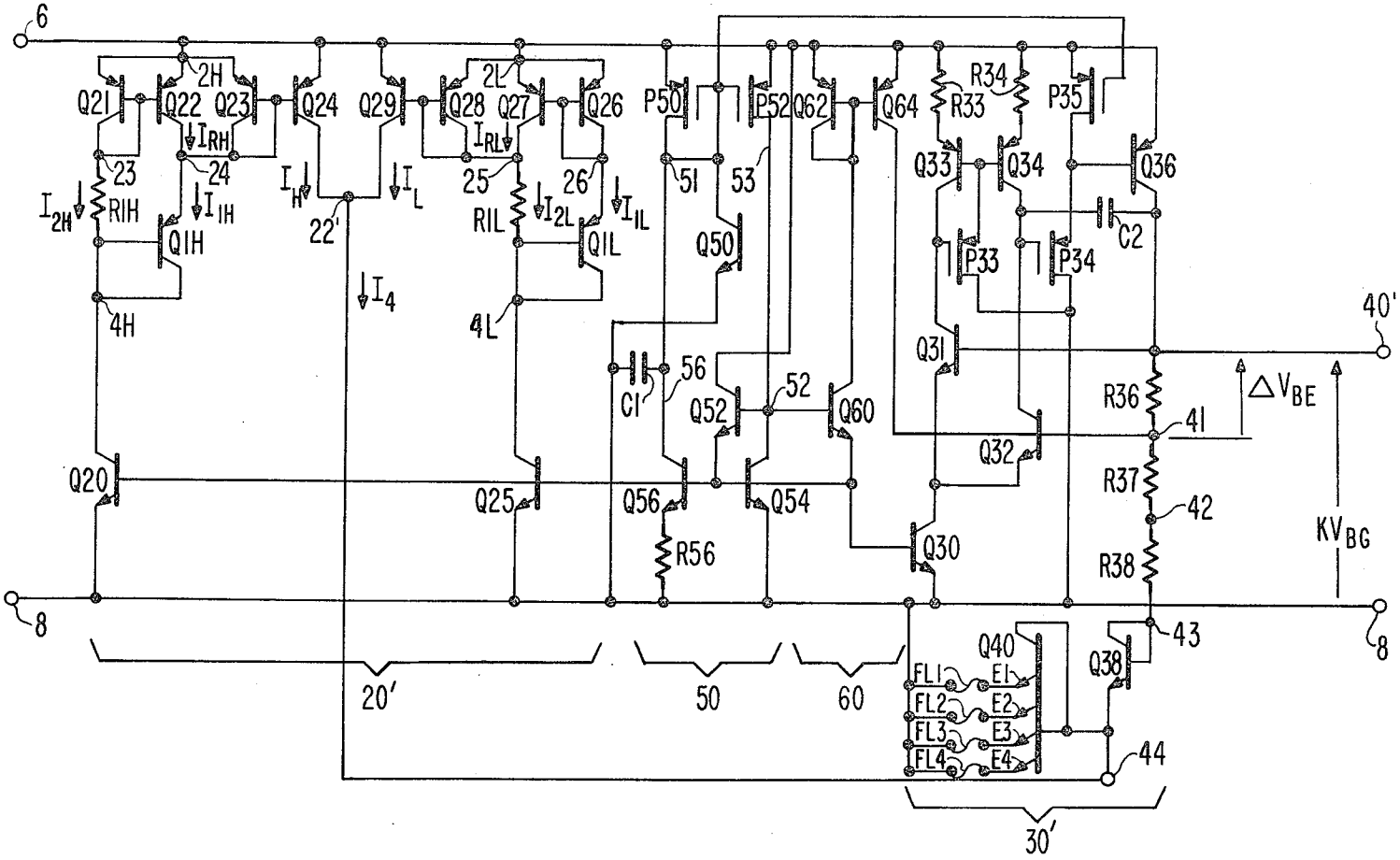

In the circuit of FIG. 5, band-gap reference circuit 30' develops reference potential $kV_{BG}$ between terminals 40' and 8. Corrective current $I_4$ developed by bow-correction network 20' is applied to reference circuit 30' to reduce the degree to which $V_{BG}$ exhibits a bow-shape responsive to temperature. Current loop 50 establishes quiescent bias currents for reference circuit 30', network 20' and, in cooperation with base-current compensation network 60, supplies base current to Q32.

Current loop 50 establishes quiescent currents for bow-correction network 20' and for reference potential generating circuit 30'. More specifically, those currents are supplied from CMA output transistors Q20, Q25, Q30 and P35. FETs P50 and P52 form a CMA which is connected in a regenerative feedback arrangement with a nonlinear CMA formed by Q52, Q54, Q56 and R56. That arrangement permits precise quiescent current levels to be established and provides means by which the relative values of quiescent currents are maintained in predetermined relationship. Equilibrium is achieved at the current level at which the product of the current gain of the P50, P52 CMA (between input connection 51 and output connection 53) times the nonlinear current ratio of the Q52, Q54, Q56 nonlinear CMA (ratio of current supplied at output connection 56 to that applied at input connection 52) is unity. See U.S. Pat. No. 4,063,149, "Current Regulating Circuits" issued to B. Crowle. Leakage current of transistor Q50 flows from node 51 to terminal 8 to render current loop 50 operative responsive to the application of operating potential between supply terminals 6 and 8. Capacitor C1 reduces the loop gain of the current loop to inhibit high-frequency oscillations.

In reference potential generating circuit 30', transistors Q31 and Q32 are conditioned to operate at different emitter current densities, their combined emitter currents being supplied by Q30. Q30 is an output transistor of the Q54, Q56 CMA in current loop 50. Resistors R33 and R34 provide degeneration to the Q33, Q34 CMA, the current gain of which determines the ratio of collector-emitter currents in Q31 and Q32. Source follower FET P33 withdraws base current from Q33 and Q34 so that their base currents do not introduce error into the current gain of the Q33, Q34 CMA. Current gain error in the Q33, Q34 CMA would tend to cause undesirable error in reference potential $kV_{BG}$. Series connected resistors R37 and R38 scale up difference $\Delta V_{BE}$ between the base-emitter potentials of Q31 and Q32 impressed across resistor R36. Diode connected transistors Q38 and Q40 serve as reference semiconductor junctions. Reference potential $kV_{BG}$ is the sum of the potentials across the series connected resistors and diode-connected transistors just recited. That potential is k times the bandgap potential (about 1.2 volts for silicon). For reference circuit 30', k=2 so the reference potential is about 2.4 volts.

Transistor Q40 has multiple emitters E1, E2, E3 and E4 of differing emitter areas (Ae) whereby its emitter current density is changed by opening a predetermined selection of fusible links FL1, FL2, FL3, and FL4 which in practice include metalization paths in an integrated circuit. By so changing the emitter current density of Q40, the value of reference potential $kV_{BG}$ is selected to be a predetermined value.

Reference potential generating circuit 30' is maintained at the predetermined equilibrium point whereat $kV_{BG}$ exhibits minimum temperature dependence by a degenerative feedback arrangement. If $\Delta V_{BE}$ across R36 tends to depart from its predetermined value, an error voltage is developed at the interconnection of the collectors of Q32 and Q34. That error voltage is applied to common-emitter amplifier transistor Q36 by source follower FET P34 causing the collector current of Q36, which flows through R36, R37, R38, Q38 and Q40, to change. The sense of that current change is such as to cause a change in potential $\Delta V_{BE}$ across R36 of opposite sense to the departure of $\Delta V_{BE}$ from its predetermined value, i.e. degenerative feedback. As a result, $\Delta V_{BE}$ and therefore $kV_{BG}$ are maintained at their predetermined values. Output FET P35 of the P50, P52 CMA supplies source current to P34 responsive to current loop 50.

Temperature-bow-correction network 20' differs from those shown in FIGS. 2 and 4 in that separate resistor-semiconductor junction pairs are provided to generate the respective temperature-dependent corrective currents. R1H and Q1H conduct temperature-dependent currents $I_{2H}$ and $I_{1H}$, respectively, from which high-temperature corrective current $I_H$ is developed. Similarly, resistor R1L and Q1L conduct temperature dependent currents $I_{2L}$ and $I_{1L}$, respectively, from which corrective current $I_L$ for temperatures lower than $T_P$ is developed. Currents from the collectors of output transistors Q20 and Q25 associated with the Q54, Q56 CMA are applied between nodes 4H, 2H and 4L, 2L, respectively, to condition Q1H and Q1L for conduction.

So that the temperature dependencies of $I_{1H}$ and $I_{2H}$ are complementary responsive to the different temperature coefficients of the resistance of R1H and the base-emitter conduction potential of Q1H, related potentials are maintained across R1H and the base-emitter of Q1H. To this end, R1 and the base and collector of Q1H connect together at connection 4H and the potential between nodes 23 and 24 is maintained in predetermined relationship through the respective base-emitter conduction potentials of transistors Q21 and Q23. To a similar end with respect to $I_{1L}$ and $I_{2L}$, R1L and the base and collector of Q1L connect together at 4L and the potential between nodes 25 and 26 is maintained in predetermined relationship through the base-emitter conduction potentials of transistors Q28 and Q26.

Reference current $I_{RH}$ is supplied to node 24 by output transistor Q22 of the Q21, Q22 CMA in response to temperature-dependent current $I_{2H}$ supplied to node 23 from R1H. $I_{RH}$ is substractively combined at node 24 with temperature-dependent current $I_{1H}$ supplied by the emitter of Q1H. The Q23, Q24 CMA develops high-temperature corrective current $I_H$ from the current resulting from the subtraction. Because $I_{1H}$ and $I_{RH}$ are temperature dependent in complementary sense, the subtractively combined current applied to Q23 is temperature dependent in proportion to the sum of the temperature dependencies of $I_{1H}$ and $I_{RH}$. Because the Q23, Q24 CMA responds only to currents flowing from node 2H to node 24 in the direction indicated by the emitter arrow of Q23, corrective current $I_H$ is substantially zero at temperatures lower than a threshold temperature $T_H$ and increases with the difference between the circuit temperature and $T_H$ for temperatures above $T_H$. In practice, $T_H$ is selected to be near to $T_P$ and is the temperature at which currents $I_{RH}$ and $I_{1H}$ are of equal value.

Similarly, reference current $I_{RL}$ is supplied to node 25 from the collector of Q27 in the Q26, Q27 CMA in response to temperature-dependent current $I_{1L}$ supplied to node 26 from the emitter of Q1L. $I_{RL}$ is subtractively combined at node 25 with temperature-dependent current $I_{2L}$ from R1L. The subtractively combined current is applied to the Q28, Q29 CMA to develop low-temperature corrective current $I_L$. $I_L$ is temperature dependent in proportion to the sum of the temperature dependencies of $I_{2L}$ and $I_{RH}$. Because the Q28, Q29 CMA responds only to currents flowing from node 2L to node 25 in the direction indicated by the emitter arrow of Q28, current $I_L$ is substantially zero at temperatures above a threshold temperature $T_L$ and increases in value as temperature departs therefrom in the direction of temperatures lower than $T_L$. In practice, $T_L$ is selected to be near to $T_P$ and is the temperature at which currents $I_{RL}$ and $I_{2L}$ are of equal value.

Currents $I_H$ and $I_L$ are combined at node 22'. Combined current $I_4$ tends to have minimum value near $T_P$ and larger values at temperatures departing therefrom, i.e. temperatures above $T_H$ and below $T_P$. $I_4$ flows to supply terminal 8 via node 44 and diode-connected transistor Q40 in reference circuit 30'. As a result of that corrective current flow, the base-emitter potential of Q40 tends to exhibit higher conduction potentials at temperatures removed from $T_P$ than it otherwise would causing reference potential $kV_{BG}$ to be increased as temperature departs from $T_P$. The magnitude of corrective current $I_4$ is made to exhibit a predetermined temperature dependence so the change induced in the base-emitter potential of Q40 by $I_4$ is substantially of equal value and opposite polarity sense to the bow in reference potential $kV_{BG}$. Thus, the degree to which reference potential $kV_{BG}$ departs from its $T_P$ value at temperatures removed from $T_P$ is substantially reduced.

Because currents $I_L$ and $I_H$ are developed independently of each other and of reference circuit 30', the design of reference potential generating circuits including an embodiment of the present invention is desirably simplified. For example, reference circuits 30 and 30' can be designed for whatever temperature $T_P$ is selected in a known manner without regard to correction current considerations. Further, design of networks for generating $I_L$ and $I_H$ can be performed separately and simply, and may have the same or different magnitudes and threshold temperatures as described hereinabove.

A further feature of the embodiment of FIG. 5 is that Q32 base current is supplied in substantial part by base current compensation network 60. This is so that the scaling up of $\Delta V_{BE}$ by the (R37+R38)/R36 ratio is not disturbed by Q32 base current. To this end, network 60 supplies a compensation current from Q64 into node 41 of value substantially equal to that of the base current withdrawn therefrom by Q32. The base currents of Q30 and Q32 are in predetermined relationship as a result of the predetermined ratio of their collector-emitter current flows determined by the relative emitter areas $A_e$ of Q33 and Q34, and by their forward current gains $h_{FE}$ being substantially equal. An appropriate base current fraction is conducted by Q60 of the Q52, Q60 pair and thence by the Q62, Q64 CMA back to node 41. Because $A_e$ for Q20, Q25, Q54, Q56 and Q30 are selected for other considerations, $A_e$ for Q52, Q60, Q62, Q64 are selected so that the compensation current supplied to node 41 from the collector of Q64 is of substantially the same value as Q32 base current.

As earlier noted, the circuit of FIG. 5 is desirably constructed in I.C. technologies wherein both bipolar and field-effect transistors are readily available, such as RCA Corporation's BIMOS process. In one such embodiment of a circuit of the type shown in FIG. 5, components and characteristics were selected as disclosed in TABLE II below.

TABLE II

| Transistor | Relative $A_e$ |
|---|---|
| Q1L, Q1H | 1 |
| Q20 | |
| Q21, Q22, Q26, Q27 | ½ |
| Q23, Q28 | ¾ |
| Q24, Q29 | ¼ |
| Q25 | 2½ |
| Q52 | 2 |
| Q54, Q60 | 1 |
| Q56 | 10 |
| Q62 | ⅔ |
| Q64 | ⅓ |
| Q30, Q31 | 1 |
| Q32 | 10 |
| Q33, Q34, Q36 | 1 |
| Q38 | 5 |
| Q40 | 1.0, 1.2, 1.4, 1.6, 1.8, 2.0 (selectable) |
| **FET** | **Relative W/1** |
| P50, P52 | 2 |
| P35 | 1 |
| **Resistors** | **Value** |
| R1H | 7kΩ |
| R1L | 14kΩ |
| R56 | 1.2kΩ |
| R33, R34 | 2kΩ |

TABLE II-continued

| | |
|---|---|
| R36 | 1.2kΩ |
| R37, R38 | 10kΩ |
| Capacitors | |
| C1, C2 | 10pF. |

Figure 6:
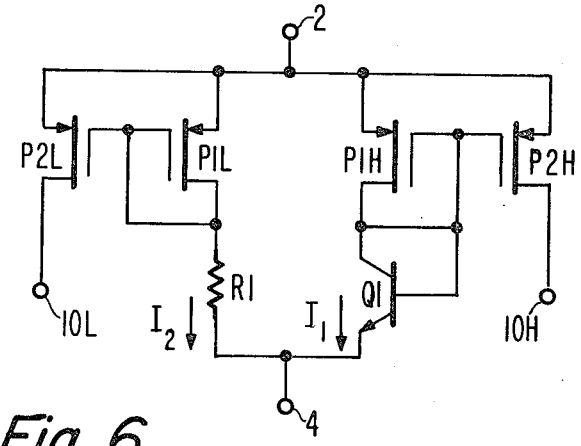
FIG. 6 is a schematic diagram of an embodiment useful in the circuit of FIG. 4.

FIG. 6 shows an alternative circuit that can be employed in the circuit of FIG. 4 to replace R1, Q1, P1, P2L, P2H, P3 and P4. The replacement is effected by connecting like numbered terminals together and replacing the P3, P4 CMA by a direct connection between nodes 12 and 13. Complementary temperature dependent currents are respectively supplied to nodes 10L and 10H by the P1L, P2L CMA and by the P1H, P2H CMA responsive to temperature dependent currents $I_2$ and $I_1$ flowing in R1 and Q1, respectively. Currents $I_{3L}$ and $I_{4L}$ flow as described above for FIG. 4. The temperature dependence of the drain current of P2H of FIG. 6 is complementary to that developed by the FIG. 4 circuit. Because the N5, N6 CMA responds only to currents flowing from node 10H to terminal 8 in the direction opposite to that indicated by the arrow associated with $I_{3H}$, current $I_{4H}$ is responsive to $I_{3H}$ at temperatures above a threshold temperature $T_H$ and is substantially zero at temperatures below $T_H$. In practice $T_H$ is the temperature at which the respective drain currents of P2H and N2H are of equal value. An advantage of the circuit of FIG. 6 is that it requires fewer FETs and has a greater symmetry between the portion generating $I_{4L}$ and the portion generating $I_{4H}$.

Modifications to the specific embodiments discussed with reference to FIGS. 1–6 are contemplated to be within the scope of the present invention as defined by the following claims. For example, in the circuits of FIGS. 2, 3, 4, 5 and 6, any of the CMAs employing FETs could be constructed with bipolar transistors and, conversely, any shown with bipolar transistors could be constructed using FETs. Similarly, the semiconductor junction could satisfactorily employ any form thereof, including, for example, a p-n junction, a Schottky barrier diode, a bipolar transistor, a field-effect transistor, and so forth.

Furthermore, in the circuit of FIG. 4 it is equally satisfactory, for example, that corrective currents $I_{4H}$ and $I_{4L}$ be injected into reference circuit 30 at different nodes. One example thereof includes eliminating the N5, N6 CMA and directly connecting connection 13 to the emitter of transistor 31.

By way of further example, in the circuit of FIG. 5, corrective current $I_4$ could be injected at node 43 instead of at the base of Q40. By way of further still example, the factor k may be made unity by connecting nodes 42 and 43 to short resistor R38 and by connecting nodes 43 and 44 to short the base-emitter junction of Q38.

Although resistor R1 is shown in FIGS. 1–6, it is equally satisfactory that any means exhibiting a resistance be employed. One such resistance means is a FET biased to exhibit a channel resistance between its source and drain electrodes. It is further satisfactory for that resistance to exhibit a substantial temperature coefficient. For example, monolithic integrated silicon resistors can exhibit a positive temperature coefficient of +1000 to +4000 parts per million per degree Kelvin which additionally enhances the change in the current division between R1 and D1 with temperature.

Although circuits including embodiments of the present invention can be desirably constructed in certain I.C. technologies, they can be readily modified to be satisfactorily embodied in other I.C. processes, for example, "standard " bipolar processes known to those skilled in the art.

What is claimed is:

1. A circuit for generating a current responsive to the difference between a threshold temperature and a temperature removed therefrom comprising:

resistance means, having first and second ends, for providing a resistance therebetween that exhibits a temperature coefficient;

semiconductor junction means having first and second electrodes, said semiconductor junction means having a conduction potential that exhibits a temperature coefficient of value different than that of said resistance;

means connected to said resistance means and to said semiconductor junction means for maintaining the potentials thereacross in predetermined relationship;

means connected to the first electrode of said semiconductor junction means for applying a current thereto to condition said semiconductor junction means for conduction;

constant current generating means for supplying a reference current of magnitude proportional to that of the current flow in one of said resistance means and said semiconductor junction means at said threshold temperature; and means for subtractively combining said reference current and a current responsive to the current flow in said one of said resistance means and said semiconductor junction means when said temperature departs from said threshold temperature in a predetermined direction to generate said current responsive to the difference between a threshold temperature and a temperature removed therefrom.

2. The circuitry of claim 1 wherein said means for subtractively combining comprises:

first and second supply terminals for receiving an operating potential therebetween;

first current mirror amplifying means having an input connection connected to said one of said resistance means and said semiconductor junction means, having a common connection connected to said first supply terminal, and having an output connection;

a node at which currents are subtractively combined; and means connecting the output connection of said current mirror amplifying means and said constant current generating means to said node.

3. The circuitry of claim 2 further comprising:

second current mirror amplifying means having an input connection to which said node connects, having a common connection connected to one of said first and second supply terminals, and having an output connection; and load means connected between the output connection of said second current mirror amplifying means of said first and second supply terminals.

4. The circuitry of claims 1, 2, or 3 wherein said means for applying a current and said constant current generating means are interconnected for supplying respective currents of responsively related magnitude.

5. The circuitry of claim 4 wherein said interconnection is included within further current mirror amplifying means having a first output connection serving as said means for applying a current and having a second output connection serving as said constant current generating means.

6. The circuitry of claim 1, 2, or 3 wherein said means for maintaining includes respective direct connections of the first and second ends of said resistance means to the first and second electrodes of said semiconductor junction means, respectively.

7. The circuitry of claim 1, 2 or 3 wherein said semiconductor junction means includes a p-n junction.

8. The circuitry of claim 7 wherein said p-n junction includes a diode.

9. The circuitry of claim 7 including a first transistor having bass and emitter electrodes and a base-emitter junction therebetween, which base-emitter junction serves as said p-n junction, and having a collector electrode.

10. The circuitry of claim 9 wherein the collector and base electrodes of said first transistor connect together.

11. The circuitry of claim 7 wherein said p-n junction is operatively associated with said means for subtractively combining in that said means for subtractively combining includes at least one transistor having base and emitter electrodes respectively connected to the first and second electrodes of said p-n junction, which base and first electrodes are of first conductivity type and which emitter and second electrodes are of second conductivity type complementary to the first, and having a collector electrode connected for supplying said current responsive to the current flow in said one of said resistance means and said semiconductor junction means.

12. The circuitry of claim 2 or 3 including a transistor having an emitter electrode serving as the first electrode of said semiconductor junction means, having a base electrode serving as the second electrode thereof, and having a collector electrode connected to the common connection of said first current mirror amplifying means.

13. In a potential generating circuit of the type wherein a pair of bipolar transistors is conditioned to operate at different emitter current densities, and the difference between their respective base-emitter junction potentials is scaled up and combined with the forward conduction potential of a reference semiconductor junction to develop a reference potential tending to have a maximum value at a predetermined temperature and lesser values at temperatures removed therefrom, the improvement comprising:

resistance means, having first and second ends, for providing a resistance therebetween that exhibits a temperature coefficient;

semiconductor junction means having first and second electrodes, said semiconductor junction means having a conduction potential that exhibits a temperature coefficient of different value than that of said resistance;

means connected to the first electrode of said semiconductor junction means for applying a current thereto to condition said semiconductor junction means for conduction;

means connected to said resistance means and to said semiconductor junction means for maintaining the potentials thereacross in predetermined relationship;

means for supplying first and second currents, which means connects to at least one of the second end of said resistance means and the second electrode of said semiconductor junction means to receive a portion of the current through said one of said resistance means and said semiconductor junction means, wherein said first and second currents are responsive to said portion of current;

constant current generating means for supplying first and second reference currents;

first means connected to said means for supplying to receive said first current and connected to said constant current generating means to receive said first reference current, for subtractively combining said first current and said first reference current and applying a current responsive thereto to said potential generating circuit to tend to increase the reference potential therefrom at temperatures departing from said predetermined temperature in a first direction; and second means connected to said means for supplying to receive said second current and connected to said constant current generating means to receive said second reference current, for subtractively combining said second current and said second reference current and applying a current responsive thereto to said potential generating circuit to tend to increase the reference potential therefrom at temperatures departing from said predetermined temperature in a second and opposite direction.

14. The improvement of claim 13 wherein said means for supplying first and second currents includes first current mirror amplifying means having an input connection for receiving said portion of current, and having first and second output connections for supplying said first and second output currents, respectively.

15. The improvement of claim 13 wherein said means for supplying first and second currents includes:

first current mirror amplifying means having an input connection for receiving said portion of current through said resistance means, and having an output connection for supplying said first current; and second current mirror amplifying means having an input connection for receiving said portion of current through said semiconductor junction means, and having an output connection for supplying said second current.

16. The improvement of claim 13, 14, or 15 wherein said first means for subtractively combining includes:

a node at which currents are subtratively combined;

means coupling said first current to said node;

means coupling said first reference current to said node; and third current mirror amplifying means having an input connection to which said node connects, and having an output connection connected to said potential generating circuit.

17. The improvement of claim 16 wherein each said current mirror amplifying means includes a respective common connection, the improvement further including:

first and second supply terminals for receiving an operating potential therebetween;

a connection of the common connection of said third current mirror amplifying means to said first supply terminal; and respective connections of the respective common connections of each other said current mirror amplifying means to said second supply terminal.

18. The improvement of claim 17 further including fourth current mirror amplifying means interposed between the output connection of said third current mirror amplifying means and said potential generating circuit, having an input connection to which the output connection of said third current mirror amplifying means connects, having an output connection connected to said potential generating circuit, and having a common connection connected to said second supply terminal.

19. The improvement of claim 16 wherein each said current mirror amplifying means includes a respective common connection, the improvement further including:

first and second supply terminals for receiving an operating potential therebetween; and respective connections of the respective common connection of each said current mirror amplifying means to said first supply terminal.

20. The improvement of claim 19 further including fourth current mirror amplifying means interposed between the output connection of said third current mirror amplifying means and said potential generating circuit, having an input connection to which the output connection of said third current mirror amplifying means connects, having an output connection connected to said potential generating circuit, and having a common connection connected to said second supply terminal.

21. The improvement of claim 13, 14 or 15 wherein said means for maintaining includes respective direct connections of the first and second ends of said resistance means to the first and second electrodes of said semiconductor junction means, respectively.

22. The improvement of claim 13, 14 or 15 wherein said semiconductor junction means includes a p-n junction

23. The improvement of claim 22 wherein said p-n junction includes a diode.

24. The improvement of claim 22 including a transistor having base and emitter electrodes and a base-emitter junction therebetween, which base-emitter junction serves as said p-n junction, and having a collector electrode.

25. The improvement of claim 24 wherein the collector and base electrodes of said transistor connect together.

26. The improvement of claim 22 wherein said p-n junction is operatively associated with said means for supplying first and second currents in that said means for supplying includes at least one transistor having base and emitter electrodes respectively connected to the first and second electrodes of said p-n junction, which base and first electrodes are of first conductivity type and which emitter and second electrodes are of second conductivity type complementary to the first, and having a collector electrode connected for supplying said first output current.

27. The improvement of claim 13 further comprising:

further semiconductor junction means having first and secondelectrodes, the first electrode of which connects to the first end of said resistance means, said further semiconductor junction means having a conduction potential that exhibits a temperature coefficient related to that of said semiconductor junction means;

further means for applying a current to said further semiconductor junction means to condition it for conduction, which current is proportionally related to the current of said means for applying a current;

further resistance means for providing a resistance that exhibits a temperature coefficient related to that of said resistance means, having a first end connected to the first electrode of said semiconductor junction means, and having a second end; and means, included within said means for maintaining, for maintaining the potentials across said further resistance means and said further semicondcutor junction means in predetermined relationship with the potentials across said resistance means and said semiconductor junction means.

28. The improvement of claim 27 wherein said constant current generating means includes:

third current mirror amplifying means having an input connection for receiving a portion of the current flow in said further resistance means, and having an output connection for supplying said first reference current; and fourth current mirror amplifying means having an input connection for receiving a portion of the current flow in said further semiconductor junction means, and having an output connection for supplying said second reference current.

29. The improvement of claim 28 wherein said first means for subtractively combining includes:

a first node at which currents are subtractively combined; means coupling said first current to said first node; means coupling said first reference current to said first node; and fifth current mirror amplifying means having an input connection to which said first node connects, and having an output connection connected to said potential generating circuit; and wherein said second means for subtractively combining includes:

a second node at which currents are subtractively combined; means coupling said second current to said second node; means coupling said second reference current to said second node; and sixth current mirror amplifying means having an input connection to which said second node connects, and having an output connection connected to said potential generating circuit.

* * * * *

UNITED STATES PATENT AND TRADEMARK OFFICE

CERTIFICATE OF CORRECTION

PATENT NO. : 4,325,018

DATED : April 13, 1982

INVENTOR(S) : Otto H. Schade, Jr.

It is certified that error appears in the above-identified patent and that said Letters Patent is hereby corrected as shown below:

Col. 1, Line 64 - After "temperature", begin a new paragraph beginning with "In";

Col. 4, Line 19 - "an" should be -- at --;

Col. 4, Line 33 - at the beginning of the line, add -- the --;

Col. 10, Line 63 - After "means" add: -- and the other --;

Col. 10, Line 65 - "claims" should be -- claim --;

Col. 11, Line 17 - "bass" should be -- base --;

Col. 13, Line 43 - after "tion" add: -- . --; and

Col. 14, Line 7 - "secondelectrodes" should be -- second electrodes --.

Signed and Sealed this

*Eighth* Day of *March 1983*

[SEAL]

*Attest:*

GERALD J. MOSSINGHOFF

*Attesting Officer*

*Commissioner of Patents and Trademarks*